US005987382A

United States Patent [19]

Weishaupt et al.

[11] Patent Number: 5,987,382

[45] Date of Patent: Nov. 16, 1999

[54] RADIO SIGNAL RECEIVER FOR MOTOR VEHICLES WITH AN RDS DECODER FOR DIGITAL SIGNALS

[75] Inventors: Walter Weishaupt; Christian Wiesmeier, both of Munich, Germany

[73] Assignee: Bayerische Motoren Werke Aktiengesellschaft, Munich, Germany

[21] Appl. No.: 08/751,364

[22] Filed: Oct. 16, 1996

[30] Foreign Application Priority Data

Oct. 16, 1995 [DE] Germany ..... 195 38 453

[51] Int. Cl.[6] ..... H04H 1/00; G08G 1/09

[52] U.S. Cl. ..... 701/211; 340/995; 455/345; 701/117

[58] Field of Search ..... 701/117, 208, 701/209, 211; 340/995, 905; 455/185.1, 186.1, 345

[56] References Cited

U.S. PATENT DOCUMENTS

| | | | |
|---|---|---|---|
| 4,398,171 | 8/1983 | Dahan et al. | 340/22 |
| 4,758,959 | 7/1988 | Thoone et al. | 364/454 |
| 5,193,214 | 3/1993 | Mardus et al. | 455/54.2 |
| 5,303,401 | 4/1994 | Duckeck et al. | 455/186.1 |
| 5,459,667 | 10/1995 | Odagaki et al. | 364/444 |
| 5,465,088 | 11/1995 | Braegas | 340/905 |
| 5,592,389 | 1/1997 | La Rue et al. | 364/449.5 |
| 5,752,177 | 5/1998 | Siegle et al. | 455/186.1 |
| 5,784,691 | 7/1998 | Rühl | 455/186.1 |
| 5,802,066 | 9/1998 | Miyake et al. | 370/527 |
| 5,835,854 | 11/1998 | Palisson et al. | 455/186.1 |

FOREIGN PATENT DOCUMENTS

| | | |
|---|---|---|
| 0 290 679 | 11/1988 | European Pat. Off. . |
| 0 580 617 | 2/1994 | European Pat. Off. . |
| 35 36 820 | 4/1987 | Germany . |
| 40 08 460 | 9/1991 | Germany . |
| 43 01 875 | 8/1993 | Germany . |
| 42 17 555 | 12/1993 | Germany . |
| 42 30 294 | 3/1994 | Germany . |
| 43 22 288 | 1/1995 | Germany . |
| 2 050 767 | 1/1981 | United Kingdom . |

OTHER PUBLICATIONS

*ELVjournal* entitled Verkehrsleitsystem—heute unde morgen—, May 1994, pp. 32–36.

*Primary Examiner*—Michael J. Zanelli
*Attorney, Agent, or Firm*—Evenson, McKeown, Edwards & Lenahan, PLLC

[57] ABSTRACT

In a radio signal receiver for motor vehicles with a radio receiver with an RDS decoder for digital signals, convertible via a table into traffic information, the signals can be forwarded from the decoder via a data link to a navigation system provided with a route data storage which generates the traffic information from the signals.

10 Claims, 2 Drawing Sheets

RADIO SIGNAL RECEIVER FOR MOTOR VEHICLES WITH AN RDS DECODER FOR DIGITAL SIGNALS

BACKGROUND AND SUMMARY OF THE INVENTION

The invention relates to a radio signal receiver for motor vehicles and, more particularly, to a radio signal receiver for motor vehicles having a radio receiver with an RDS (radio data system) decoder for digital signals, convertible through the use of a table into traffic information.

Traffic information is known to those in the field as TMC (traffic message channel). The problems of such a radio receiver have to do with the adjustment of, or changes in, the table for the standard on which it is based and the data used to code and decode the digital signals. These include local codes and standard text. A radio receiver is disclosed as a radio signal receiver of the type referred to above in German patent document DE-OS 35 36 820; this receiver contains the local codes and standard text in a fixed-value storage medium and decodes the codes transmitted and forms speech information from them. It is not possible to adjust to an altered standard, for example, with this system.

European patent document EP 0 580 617 B1 describes a radio receiver in which an attempt is made to overcome the above-described problem as follows: a chip card containing the local codes and additional data for conversion of the digital signals in a data storage can be inserted into the radio receiver. Adjustment to an altered standard and changed road conditions and local codes can be effected by replacing the chip card. Changes in local names can be taken care of by replacing the chip card. However, a radio receiver of this type is expensive, as it has to have a chip card reader. Moreover, it is not easy to use the chip card as it can easily be removed and become lost.

The goal of the invention is to create a radio signal receiver of the type discussed above in which the radio receiver does not have to be changed or adjusted when standards, local codes, and the like, change, and moreover offers the option of easy adjustment, changing, and updating.

The invention achieves this goal by a radio signal receiver for motor vehicles having a radio receiver with an RDS decoder for digital signals, convertible through the use of a table into traffic information. The signals can be forwarded from the decoder via a data link to a navigation system provided with a route data storage. The navigation system contains the table and generates the traffic information.

It is advantageous for the navigation system to convert the traffic information into acoustic information by means of a speech storage.

It is a further advantage of the present invention that the navigation system outputs the traffic information as visual information. The navigation system enters the traffic information in the map section being displayed, preferably the planned route. The radio signal receiver further contains a storage for at least some of the digital signals.

Other objects, advantages and novel features of the present invention will become apparent from the following detailed description of the invention when considered in conjunction with the accompanying drawings.

DETAILED DESCRIPTION OF THE DRAWINGS

Referring to the figures, traffic information is now reproduced with the aid of a navigation system in a vehicle. Since the navigation system contains the route data storage, it can also store the table necessary for converting the digital signals regarding the traffic information. Adjustments and changes can easily be made in connection with corresponding modifications of the navigation system by using a new route data storage with a correspondingly altered table for the TMC information. In addition, when local names change, the necessary adjustments for the RDS/TMC information can readily be made. Foreign-language texts can also be provided for reproducing the traffic information by using a suitably designed table in the navigation system.

Since the route data storage contains not only local information but also other data needed for output of traffic information, such as standard texts, directional information, and the like, total reproduction of traffic information, with the exception of decoding the RDS signal from the radio receiver, is based on the navigation system. This information is output with the aid of the navigation system.

Output can be in the form of acoustic information, e.g. with the aid of the speech output system of the navigation system, or visually, for example in the map section displayed on the screen.

In addition, the connection between the TMC radio receiver and the navigation system makes it possible to automatically display only messages on the selected travel route rather than the total range of messages.

If a route has not been preselected, the navigation system can at least establish a limited target corridor (calculated from the position on the road being traveled and the direction of travel thus far) in which the driver is warned of traffic problems. In both cases, a time-consuming input procedure for selective message choices is unnecessary.

Figure 1:
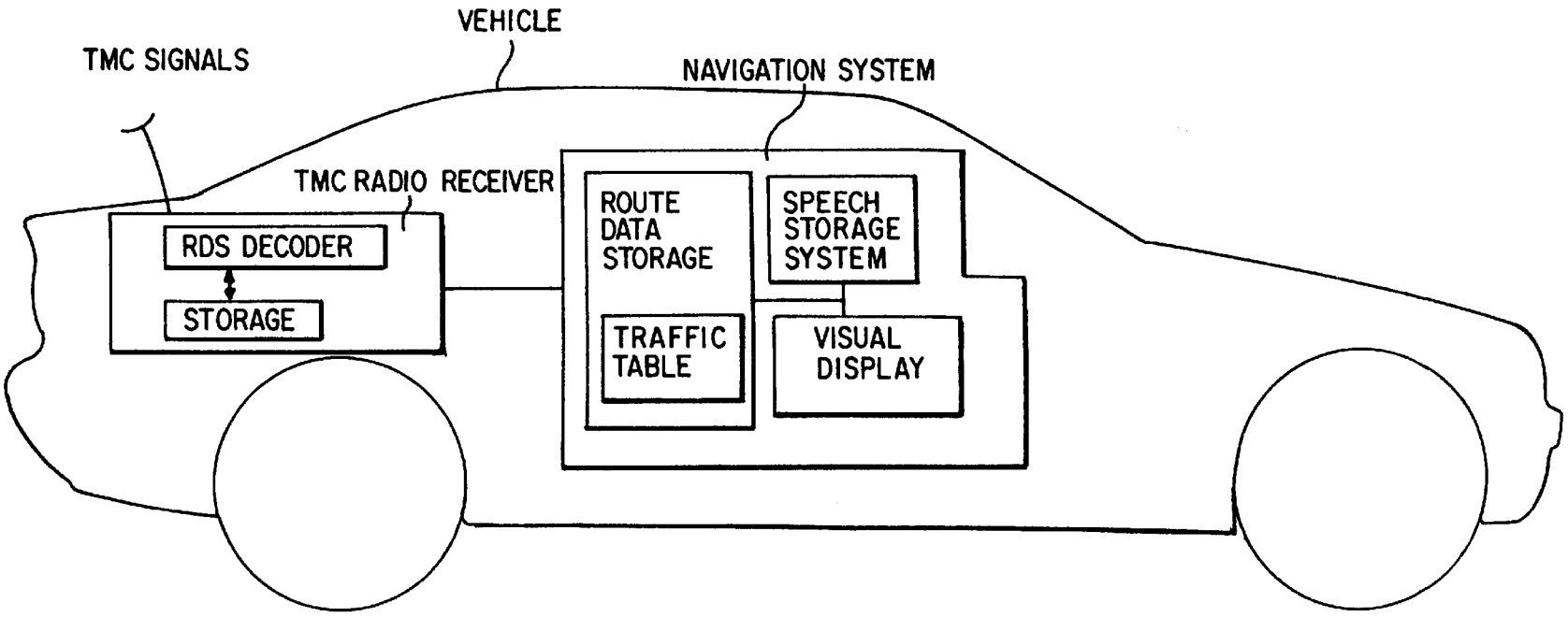
FIG. 1 is a schematic block diagram according to the present invention.
Figure 2A:
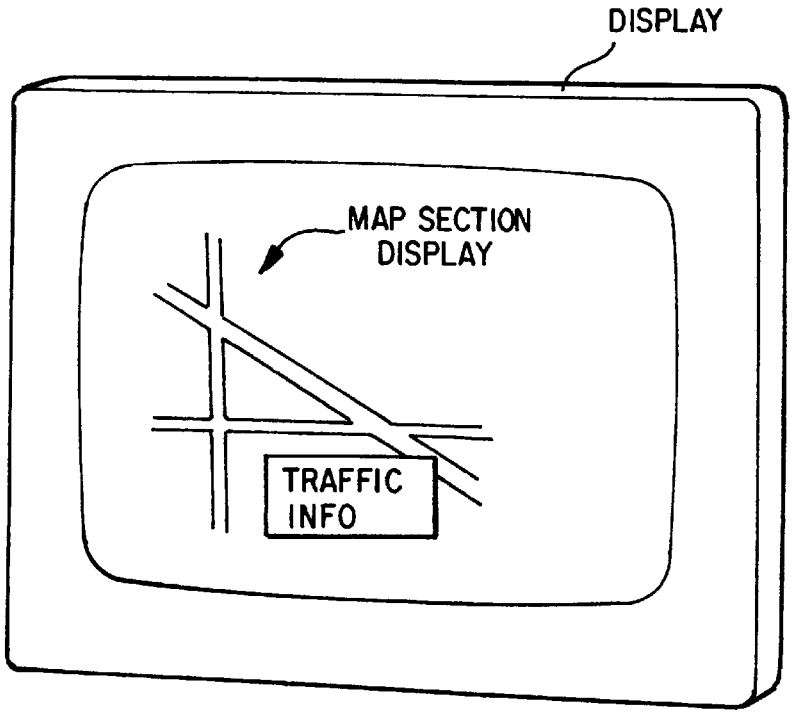
FIGS. 2A and 2B are schematic diagrams illustrating different embodiments with respect to the visual display according to the present invention.
Figure 2B:
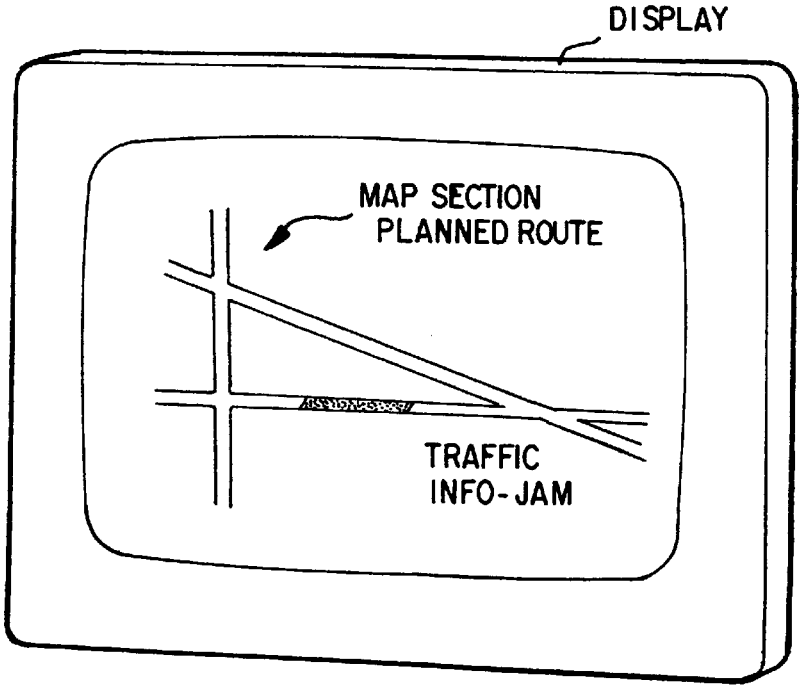

The choice of displaying TMC messages on the chosen or displayed map section (FIG. 2A) and/or the route (FIG. 2B), can be made for example by selecting "TMC" from a menu for a vehicle information system containing the navigation system. When this choice has been made, detailed TMC messages are displayed, and may be temporarily stored in the radio receiver. If this choice is not made, TMC messages are ignored.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A radio signal receiver for a motor vehicle, comprising:

a radio receiver having an RDS decoder which decodes digital signals that are convertible through the use of a table into traffic information;

a navigation system having a route data storage, said navigation system containing said table; and a data link which forwards said digital signals from said RDS decoder to said navigation system, wherein said navigation system uses said table to generate the traffic information;

wherein said navigation system enters said traffic information into a map section being displayed.

2. The radio signal receiver according to claim 1, wherein said navigation system enters said traffic information into a planned route of said map section being displayed.

3. The radio signal receiver according to claim 2, wherein said radio signal receiver further includes a storage device for at least some of said digital signals.

4. The radio signal receiver according to claim 1, wherein said radio signal receiver further includes a storage device for at least some of said digital signals.

5. A radio signal receiver for a motor vehicle, comprising:

a radio receiver having an RDS decoder which decodes digital signals that are convertible through the use of a table into traffic information;

a navigation system having a route data storage, said navigation system containing said table; and a data link which forwards said digital signals from said RDS decoder to said navigation system, wherein said navigation system uses said table to generate the traffic information;

wherein said navigation system further comprises a speech storage system which converts said traffic information into acoustic information;

wherein said navigation system enters said traffic information into a map section being displayed.

6. The radio signal receiver according to claim 5, wherein said radio signal receiver further includes a storage device for at least some of said digital signals.

7. The radio signal receiver according to claim 5, wherein said navigation system enters said traffic information into a planned route of said map section being displayed.

8. A radio signal receiver for a motor vehicle, comprising:

a radio receiver having an RDS decoder which decodes digital signals that are convertible through the use of a table into traffic information;

a navigation system having a route data storage, said navigation system containing said table; and a data link which forwards said digital signals from said RDS decoder to said navigation system, wherein said navigation system uses said table to generate the traffic information;

wherein said navigation system includes a display which outputs said traffic information;

wherein said navigation system enters said traffic information into a map section being displayed.

9. The radio signal receiver according to claim 8, wherein said radio signal receiver further includes a storage device for at least some of said digital signals.

10. The radio signal receiver according to claim 8, wherein said navigation system enters said traffic information into a planned route of said map section being displayed.

* * * * *